United States Patent [19]

Still, Jr.

[11] Patent Number: 4,524,533

[45] Date of Patent: Jun. 25, 1985

[54] REALTOR SIGN SYSTEM

[76] Inventor: Samuel A. Still, Jr., P.O. Box 8, Still Rd., Ft. Motte, S.C. 29050

[21] Appl. No.: 560,246

[22] Filed: Dec. 12, 1983

[51] Int. Cl.[3] ..... G09F 15/00

[52] U.S. Cl. ..... 40/607; 40/606; 40/610; 40/611; 40/479; 248/156; 248/530

[58] Field of Search ..... 40/606, 607, 605, 610, 40/611, 603, 479, 613, 612, 506, 504, 503, 492, 497; 248/159, 156, 157, 158, 161, 168, 404, 529, 530, 532, 533

[56] References Cited

U.S. PATENT DOCUMENTS

| | | | |
|---|---|---|---|
| 831,496 | 9/1906 | Bell | 40/479 |
| 1,121,491 | 12/1914 | Gasson | 40/606 |
| 1,164,996 | 12/1915 | Davies | 40/607 |
| 1,214,534 | 2/1917 | Gaffney | 40/613 |
| 1,294,957 | 2/1919 | Scott | 40/607 |
| 1,507,487 | 9/1924 | Klitz | 40/479 |
| 1,565,285 | 12/1925 | Merker | 40/613 |
| 1,649,249 | 11/1927 | Newman | 40/607 |
| 1,660,984 | 2/1928 | Baggott | 40/611 |
| 1,794,677 | 3/1931 | Dunwody | 40/479 |
| 2,084,816 | 6/1937 | Littlefield | 40/607 |
| 2,580,948 | 1/1952 | Pancake | 40/606 |
| 3,550,297 | 12/1970 | Friedrichsen | 40/603 |
| 3,908,943 | 9/1975 | Bannister | 248/159 |
| 4,219,179 | 8/1980 | Silbernagel | 40/606 |
| 4,233,769 | 11/1980 | Archer | 40/610 |
| 4,249,715 | 2/1981 | Repp | 40/607 |
| 4,326,352 | 4/1982 | Barth | 40/607 |
| 4,357,772 | 11/1982 | Amick et al. | 40/605 |

*Primary Examiner*—Gene Mancene
*Assistant Examiner*—James Hakomaki
*Attorney, Agent, or Firm*—B. P. Fishburne, Jr.

[57] ABSTRACT

A convenient and versatile realtor sign system is separable into components which are easily carried in an automobile trunk or back seat compartment. The sign is easily set up at a property site with a desired number of stacked auxiliary sign sections containing various indicia. A convenient low effort driving tool for the ground penetrating main standard of the sign is included. The main sign panel is attachable to the realtor's automobile door through the same apertures which connect the main sign panel to the separable ground-mounted support structure.

3 Claims, 9 Drawing Figures

REALTOR SIGN SYSTEM

BACKGROUND OF THE INVENTION

Realtor's signs are extremely important to real estate sales persons and a variety of sign structures are used in the business ranging from cheap paper signs which can be tacked or stapled to a wooden stake to much more expensive signs formed of metal or other durable materials which have a much longer useful life.

Generally, in the prior art, the structures of signs used by realtors are widely varied, some being much more convenient and practical than others. Persons who must use these signs frequently complain about the difficulty and inconvenience in carrying them in an automobile, their general awkwardness, and the difficulties involved in placing the sign standards in hard ground. To deal with these problems, real estate agents sometimes must carry several tools such as a hammer, screwdriver and wrenches in their automobiles.

In short, there is a real need in the art for a more convenient, durable and versatile sign structure which is easy to transport in an automobile in a knocked-down state, and which can be placed in the ground and easily assembled at a property site with an absolute minimum of physical effort and toolage.

The object of the present invention is to provide a realtors' sign system which completely answers or satisfies all of the above needs in an economical and practical way.

Another object of the invention is to provide a realtor's sign system which is expandable to include any required number of add-on auxiliary sign components, and which is readily adjustable horizontally and vertically to accommodate sign panels of various sizes whose mounting holes have various spacings horizontally and vertically.

Other features and advantages of the invention will become apparent to those skilled in the art during the course of the following detailed description.

DETAILED DESCRIPTION

Figure 1:
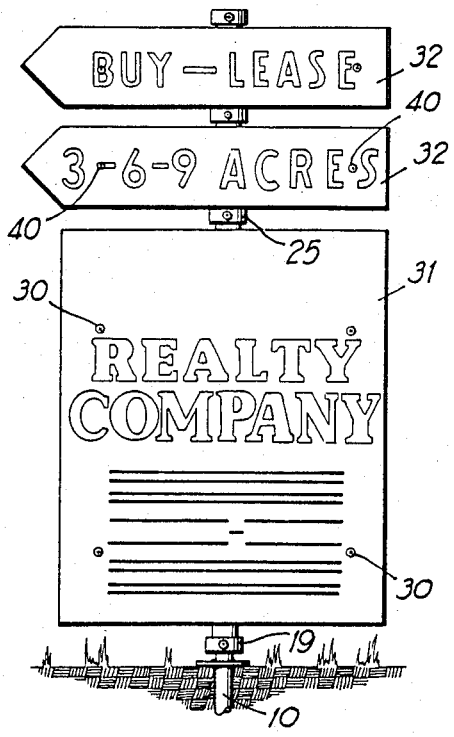
FIG. 1 is a front elevation of a realtor's sign according to the invention in the erected state at a property site.

Referring to the drawings in detail wherein like numerals designate like parts, a sign post or standard 10 of any required length has a leading point 11 to penetrate the soil and carries a fixed driving disc 12 near its top end. To facilitate placing the standard 10 in the soil, a manual driver 13 is provided, including a straight tube section 14 having a lower end driving disc 15 and a hand guard disc 15' near its upper end. A handle extension 16 is provided above the guard disc 15'. In some instances, the lower driving disc 15 can be omitted.

Figure 5:
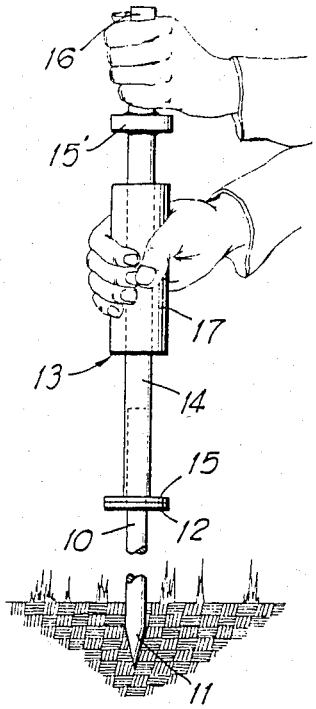
FIG. 5 is an elevational view of a sign standard driver in association with a sign standard being driven.

Slidably engaged on the driver tube 14 is a reciprocatory hand-operated sleeve weight 17 or impact member. In use, the driver tube is telescoped over the top end of standard 10, and the disc 15, when provided, is placed in contact with the disc 12, FIG. 5. The user steadies the driver with one hand on the handle 16, while the weight 17 is reciprocated vertically by the other hand to drive the standard 10 into the soil to a suitable depth, after which the driver is separated from the standard 10.

The sign system further comprises a lower sleeve member 18 which telescopes over the top of the standard 10 above the fixed disc 12 thereof and may rest on this disc. A set collar 19 fixed to the lower end of sleeve 18 carries a set screw 20 by means of which the sleeve 18 is releasably locked on the standard 10. A right angular fixed support bar 21 carried by lower sleeve 18 near its upper end extends equidistantly on opposite sides of the sleeve 18 and has telescopically mounted thereon adjustably a pair of horizontal support sleeves 22.

Fixed in the upper end portion of lower sleeve 18 is a vertical support bar 23 receiving thereon telescopically a vertically adjustable upper sleeve or tube 24 which is considerably longer than the lower sleeve 18. At its top, the upper sleeve 24 carries a fixed set collar 25 having a set screw 26 therein.

Somewhat below its top end, the sleeve 24 carries a fixed right angular horizontal support bar 27 identical to the bar 21 and receiving telescopically and adjustably thereon a pair of horizontal support sleeves 28 which are identical to the sleeves 22.

The four horizontally adjustable sleeves 28 have sign panel support apertures 29 formed therethrough near their outer ends which receive screws 30 serving to attach a main rectangular sign panel 31 to the four sleeves 28. The rectangular main sign panel has four apertures formed therethrough near its corner which receive the four screws 30. The size of the sign panel 31 and the spacing of its apertures may vary, and the horizontal adjustability of the sleeves 28 and vertical adjustability of the sleeve 24 allows the apertures 29 to be brought into registration with the apertures of the main sign panel 31 regardless of its size and the relative spacing of its four apertures on rectangular coordinates.

The indicia content of the main sign panel 31 is completely variable, and typical indicia is shown in FIG. 1 for the sake of illustration.

Figure 2:
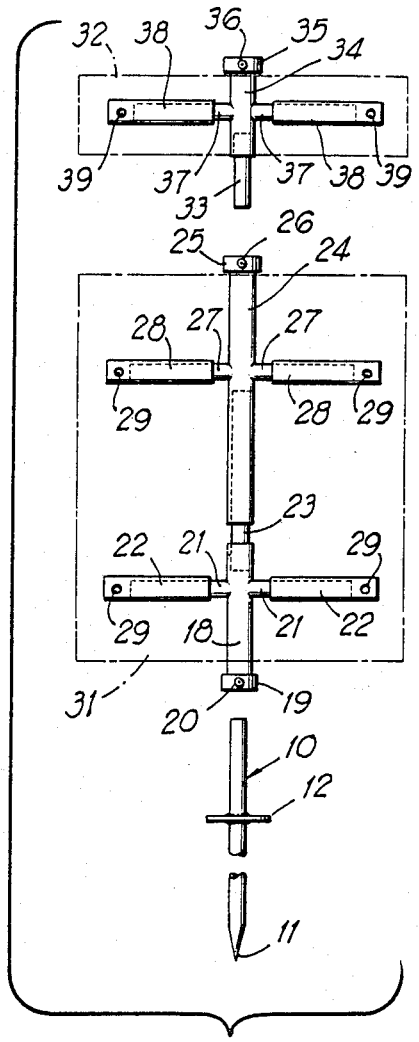
FIG. 2 is an exploded front elevation of the sign structure.
Figure 3:
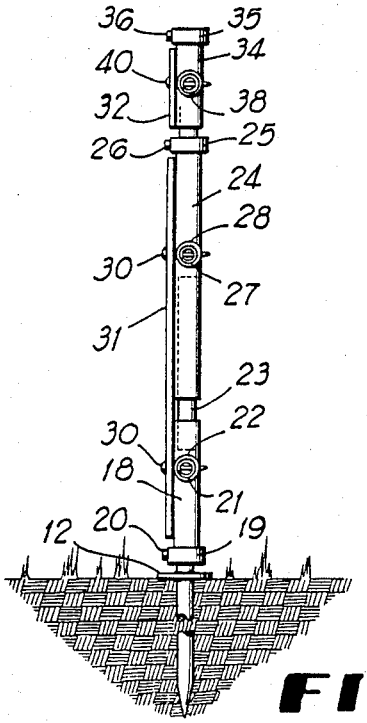
FIG. 3 is a side elevation of the sign structure in the assembled erected state.
Figure 4:
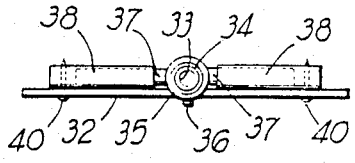
FIG. 4 is a plan view of the same.

The basic realtor sign system thus far described can be used as described with only the main sign panel 31 thereon. However, more usually, one or more add-on vertically stacked auxiliary smaller sign panels 32 are usually desired and necessary to satisfy the needs of the realtor or salesperson. Consequently, an important feature of the invention comprises means for attaching a required number of stacked auxiliary sign panels 32 to the top of the main or basic sign structure. This means comprises a relatively short vertical bar 33 which engages telescopically into the top of sleeve 24 and is locked therein by the set screw 26 of collar 25. A comparatively short vertical sleeve 34 fixedly telescoped with the bar 33 extends above the latter and carries another set collar 35 and set screw 36 by means of which an additional auxiliary sign panel 32 having a vertical bar 33 and sleeve 34 may be mounted and locked atop the panel 32 shown in FIG. 2. In this manner, any required number of auxiliary sign panels can be stacked vertically above the main or basic sign by adding a corresponding number of the telescoping elements 33 and 34 and their associated parts.

Above the bar 33, vertical sleeve 34 carries a right angular horizontal support bar 37 substantially identical to the bars 21 and 27, and on which are adjustably telescopically mounted a pair of horizontal support sleeves 38 similar to the sleeves 22 and 28, and having transverse apertures 39 near their outer ends, receiving therethrough screws 40 for the attachment of the auxiliar sign panel 32, the latter having a pair of spaced apertures which register with the screw-receiving apertures 39.

It should now be clear that the realtor sign system is easily expandable vertically and highly versatile in terms of the varied indicia which can be displayed on the auxiliary sign panel or panels 32. The sign system is adjustable both horizontally and vertically to support sign panels of various sizes and various screw aperture spacings. The structure is rigid and very durable. It is easy to knock-down and erect, requiring nothing but a small screwdriver to operate the several set screws. Furthermore, in the knocked-down state, the sign system is compact for easy placement in an automobile trunk or the like.

A further and optional feature of the invention comprises a simplified means for mounting the main sign panel 31 to an automobile door 41 of the vehicle used by the realtor in connection with his or her business.

Figure 6:
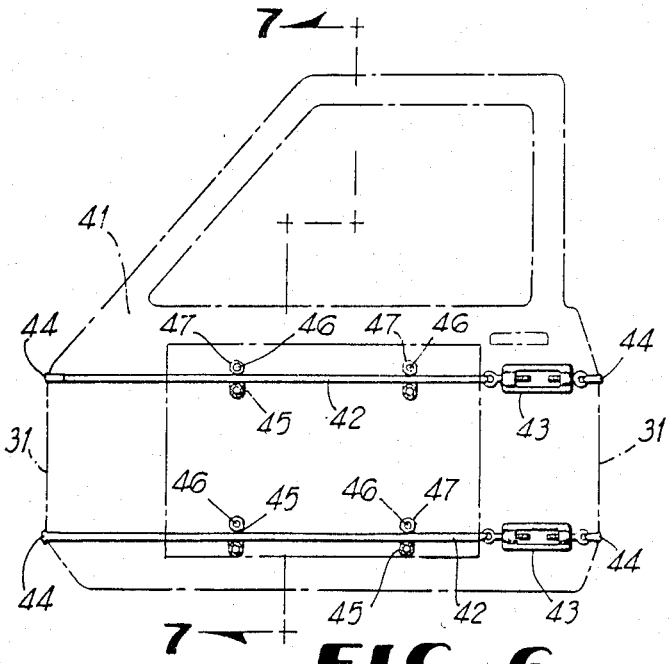
FIG. 6 is a front elevational view of means to mount the realtor's sign according to the invention on the door of an automobile.
Figure 7:
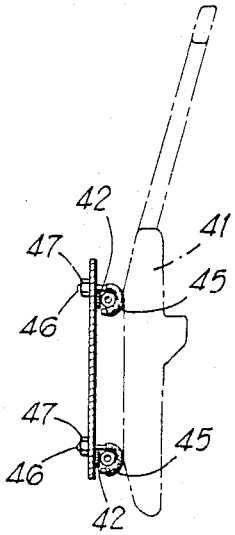
FIG. 7 is a vertical section taken on line 7—7 of FIG. 6.

In connection with this feature, with particular reference to FIGS. 6 and 7, a pair of horizontal longitudinally adjustable rod or strap members 42 equipped with adjusting turnbuckles 43, or equivalent means, have hooked terminal ends 44 which embrace the opposite edges of the vehicle door 41.

Hook mounting brackets 45 have threaded shanks 46 received by the four apertures of main sign panel 31, with the hooked ends of brackets 45 engaging between the straps 42 and the side surface of the door 41. The elements 44 and 45 are coated with rubber or the like to prevent marring the door finish. The threaded shanks 46 of hook brackets 45 carry nuts 47. Thus the arrangement in FIGS. 6 and 7 allows the quick and convenient detachable mounting of the same sign panel 31 depicted in FIGS. 1 and 2 on the realtor's automobile door, thereby rendering the sign system even more useful and versatile.

Figure 8:
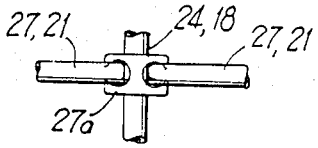
FIG. 8 is a fragmentary front elevation showing a modified adjustment joint between crossing members of the sign system.
Figure 9:
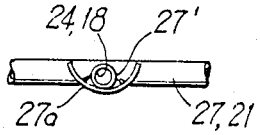
FIG. 9 is a fragmentary plan view thereof.

In some cases, it is necessary to have the horizontal arms 21 and 27 adjustable vertically on the sleeves 18 and 24. This necessity arises because of variations in the distances between the top and bottom edges of the rectangular sign panel 31 and its four mounting apertures. It is desirable to maintain approximately the relationships shown in FIG. 1 for the top and bottom edges of the panel 31 and the two set collars 25 and 19. When such additional adjustment is required, the arrangement shown in FIGS. 8 and 9, or some equivalent arrangement, can be utilized.

Instead of having the arms 21 and 27 fixed on the vertical sleeves 18 and 24, and therefore non-adjustable vertically, the arms 21 and 27 are formed separately from the sleeves 24–18 and the arms can be recessed at 27' in corresponding sides to receive the sleeves 24–18 thereacross at right angles in substantially a common plane. The crossing members are connected adjustably through metal spring clips **27*a* which bind the parts together frictionally. Other forms of adjustable connections may be employed including set collars slidable on the members 18 and 24 and carrying the arms 21 and 27**.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A sign system for realtors and like comprising an elongated sign support standard adapted to be driven in the soil for anchorage therein and having a driving element between its ends adapted to contact the surface of soil into which the standard is driven, a first sleeve engageable telescopically and adjustably over the top of the standard and having a lower end locking set screw adapted to engage the standard for locking the first sleeve thereon at a prescribed height, a cross bar on the first sleeve between its ends substantially at right angles thereto and projecting equidistantly on opposite sides thereof, a pair of sign panel support sleeves telescopically and adjustably mounted on said cross bar on opposite sides of the first sleeve and having transverse apertures formed therethrough near their outer ends, a bar fixed coaxially within the first sleeve and extending beyond one end of the first sleeve, a second sleeve engaged telescopically and adjustably with the last-named bar and being coaxial therewith and being extendable and retractable on the last-named bar away from and toward the cross bar, a second cross bar on the second sleeve between its ends substantially at right angles thereto and parallel to the first-named cross bar and projecting equidistantly on opposite sides of the second sleeve, another pair of sign panel support sleeves telescopically and adjustably mounted on the last-named cross bar on opposite sides of the second sleeve and having transverse apertures formed therethrough near their outer ends, the second sleeve having an upper end locking set screw, a comparatively short bar coaxially telescopically engageable within the second sleeve and adapted to be locked therein by the last-named set screw, a comparatively short sleeve coaxially receiving one end of the comparatively short bar and fixed thereto and having a set screw near one end thereof away from the comparatively short bar, whereby the comparatively short sleeve can receive telescopically and be locked to another coaxial bar of an auxiliary sign support structure, a third cross bar on the comparatively short sleeve between its ends substantially at right angles thereto and projecting equidistantly on opposite sides thereof, and a pair of auxiliary sign panel support sleeves telescopically and adjustably mounted on the third cross bar on opposite sides of the comparatively short sleeve and having transverse apertures formed therethrough near their outer ends.

2. A sign system for realtors and the like as defined in claim 1, and a spring clamping element engaging and frictionally securing said cross bar, second cross bar and third cross bar on the first, second and comparatively short sleeves, whereby such cross bars can be separated from the first, second and comparatively short sleeves.

3. A sign system for realtors and the like comprising a sign support standard adapted to penetrate soil in a substantially upright mode, an upright longitudinally extensible and retractable telescoping sleeve and bar member coaxial with and telescopically and adjustably engaged with the standard, means to lock the lower end of the sleeve and bar member on said standard at a selected height thereon, a pair of spaced parallel longitudinally extensible and retractable substantially horizontal telescoping sleeve and bar members on the first-named sleeve and bar member at right angles to the latter and having transverse apertures formed therethrough near opposite ends thereof, longitudinal extension and retraction of the first-named bar member serving to bodily move said horizontal telescoping sleeve and bar members bodily away from and toward each other, an auxiliary sign support structure above the first-named telescoping sleeve and bar member and including a depending bar element telescopically and adjustably engageable within the top of the first-named bar member, and means to lock said depending bar element within the first-named bar member at a selected height.

* * * * *